United States Patent [19]

Saito et al.

[11] 4,076,770

[45] Feb. 28, 1978

[54] CARBURETOR WITH AUXILIARY ACCELERATOR-PUMP SYSTEM

[75] Inventors: Haruhiko Saito, Nagoya; Michio Morishita, Toyota, both of Japan

[73] Assignee: Toyota Jidosha Kogyo Kabushiki Kaisha, Toyota, Japan

[21] Appl. No.: 782,347

[22] Filed: Mar. 29, 1977

[30] Foreign Application Priority Data

Nov. 16, 1976 Japan ..... 51-136857

[51] Int. Cl.[2] ..... F02M 7/08

[52] U.S. Cl. ..... 261/34 A; 261/34 B; 261/39 A

[58] Field of Search ..... 261/34 A, 34 B, 39 A

[56] References Cited

U.S. PATENT DOCUMENTS

| | | | |
|---|---|---|---|
| 1,896,499 | 2/1933 | Tice | 261/34 B |
| 1,930,423 | 10/1933 | Eriksson | 261/34 A |
| 2,067,713 | 1/1937 | Kommer | 261/34 A |
| 2,212,946 | 8/1940 | Mock et al. | 261/34 A |
| 2,252,960 | 8/1941 | Brown | 261/41 D |
| 3,618,581 | 11/1971 | Simonet | 261/DIG. 74 |
| 3,911,062 | 10/1975 | Johnson | 261/34 A |
| 4,018,856 | 4/1977 | Hamakawa et al. | 261/23 B |

*Primary Examiner*—Tim R. Miles

*Attorney, Agent, or Firm*—Stevens, Davis, Miller & Mosher

[57] ABSTRACT

A carburetor with an auxiliary accelerator-pump system including a diaphragm pump. This diaphragm pump includes a fuel chamber and a vacuum chamber which are separated by a spring-loaded diaphragm. The fuel chamber leads by way of a check valve to a fuel reservoir or float bowl in the carburetor and by way of another check valve to a pump jet or nozzle which is open into the intake passage of the carburetor, while the vacuum chamber leads to a vacuum take-off port open into the intake passage downstream of its throttle valve. This fuel chamber is communicated by way of a valve with the fuel reservoir or float bowl, the aforesaid valve being actuated in response to a vacuum prevailing in the intake passage downstream of the throttle valve.

9 Claims, 3 Drawing Figures

CARBURETOR WITH AUXILIARY ACCELERATOR-PUMP SYSTEM

BACKGROUND OF THE INVENTION

1. Field of the Invention

This invention relates to a carburetor with an auxiliary accelerator-pump system, and more particularly to a carburetor having an accelerator-pump system which can cope with fuel leakage into the intake passage due to an ambient temperature rise.

2. Description of the Prior Art

It is known that the operational characteristics of an internal combustion engine under cold weather can be improved by providing a vacuum-operated auxiliary diaphragm pump which operates only when the engine is cold, in addition to a mechanical accelerator pump which is adapted to supply additional fuel to the engine upon the sudden opening of the throttle valve.

With prior art diaphragm pumps of this type, the interior of the pump is separated by a spring-loaded diaphragm into a vacuum chamber (a vacuum is introduced therein from an intake passage in a carburetor) and a fuel chamber. The vacuum chamber is communicated by way of a temperature responsive valve, which is adapted to be closed at temperatures above a given level, with a vacuum take-off port in the intake passage, while the fuel chamber is communicated by way of a first check valve to a lower portion of a fuel reservoir or float bowl on one hand and on the other hand by way of a second check valve to a pump jet which opens into the intake passage.

When the ambient temperature is raised and hence the fuel pressure in the auxiliary accelerator-pump is increased, the fuel present in the fuel chamber or in a passage leading thereto tends to leak through the pump jet into the intake passage, thereby providing an excessively rich mixture charge and thus impairing the desired operation of the engine.

RELATED APPLICATIONS

A related application is the Assignee's U.S. Application Ser. No. 777,577 filed Mar. 15, 1977 (Attorney's Docket No. WAK/13947) entitled Carburetor With Auxiliary Accelerator-Pump System, disclosing another system having a vacuum operated valve.

SUMMARY OF THE INVENTION

It is an object of the present invention to provide a carburetor with an auxiliary accelerator-pump system which can avoid the aforesaid shortcomings experienced with prior art carburetors, i.e., leakage of fuel into the intake passage of the carburetor, when the ambient temperature exceeds a given temperature level.

It is a further object of the present invention to provide a carburetor with an auxiliary accelerator-pump system, which may bleed fuel into a fuel reservoir through a simple, vacuum responsive valve means, when the ambient temperature goes above a given temperature level, thereby avoiding leakage of fuel from the auxiliary accelerator-pump into the intake passage.

According to the present invention, there is provided a carburetor with an auxiliary accelerator-pump system, which comprises: an intake passage including a venturi portion and a throttle valve; a fuel reservoir or float bowl; an auxiliary accelerator-pump including a fuel chamber and a vacuum chamber, which are separated by a spring-loaded diaphragm, the vacuum chamber being communicated with a portion of the intake passage downstream of the throttle valve, and the fuel chamber being communicated by way of a first check valve with a pump jet opening into the intake passage upstream of the venturi portion as well as by way of a second check valve to a lower portion of the fuel reservoir, which is filled with fuel, the fuel chamber being further communicated by way of a vacuum responsive valve means, with an upper portion of the fuel reservoir, which is above the level of the fuel therein, and the vacuum responsive valve means being adapted to be actuated in response to the vacuum prevailing in the intake passage downstream of the throttle valve.

DESCRIPTION OF THE PREFERRED EMBODIMENTS

Figure 1:
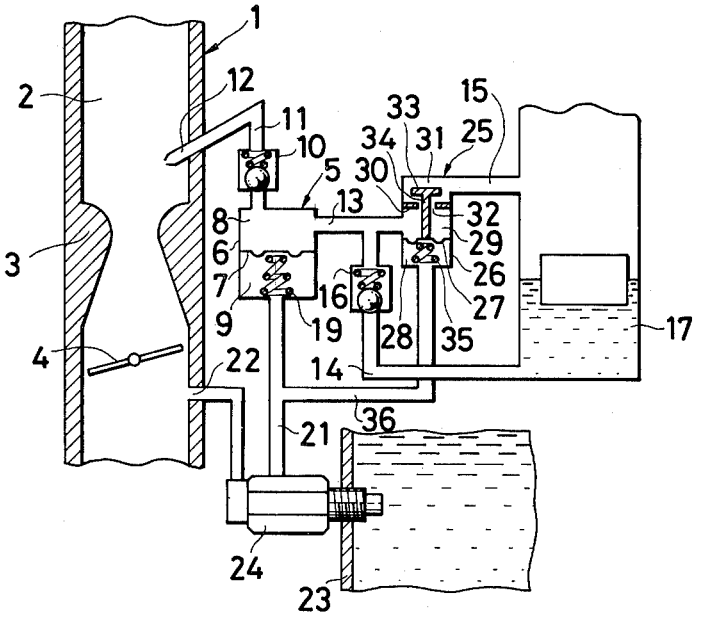
FIG. 1 is a schematic diagram of one embodiment of a carburetor with an auxiliary accelerator-pump system according to the present invention.
Figure 2:
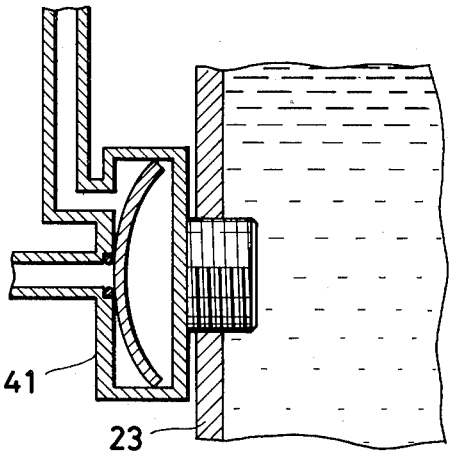
FIG. 2 is an enlarged view of a temperature responsive valve means of a bimetal disc type, which is interposed between the vacuum chamber in the auxiliary accelerator-pump and an intake passage of the carburetor.

For simplicity of description, well known circuits for a carburetor, i.e., a float circuit, an idling-low speed circuit, a high speed circuit and an accelerator pump circuit cooperating with a throttle valve are omitted from FIGS. 1 and 2.

Referring to FIG. 1, the body 1 of the carburetor includes an air horn 2, venturi 3 and throttle valve 4 provided in the air horn 2 downstream of the venturi 3. A housing 6 of an auxiliary accelerator diaphragm pump 5 is partitioned by a vacuum-operated and spring-loaded diaphragm 7 into a fuel chamber 8 and a vacuum chamber 9. The fuel chamber 8 is communicated by way of a passage 11 including a check valve 10 to a pump jet 12 which opens into the air horn 2 upstream of the venturi 3. The aforesaid check valve 10 allows only the flow of fuel towards the pump jet 12. A passage 13 leading from the chamber 8 is branched into two branch passages 14, 15. The branch passage 14 having a check valve 16 adapted to allow only the flow of a fluid towards the intake passage is connected to a lower portion of a fuel reservoir or float bowl 17, while the branch passage 15 is open into a portion of the float bowl 17 above its fuel level.

A coil spring 19 is disposed within the vacuum chamber 9. One end of the spring 19 is supported by the inner wall of the housing 6, while the other end of the spring 19 urges diaphragm 7 towards the fuel chamber 8. The vacuum chamber 9 is communicated by way of a passage 21 with a vacuum take-off port 22 positioned downstream of the throttle valve 4 in the carburetor. Positioned in the passage 21 is a heat sensitive valve 24 having a heat sensitive portion (with wax fill therein). The heat sensitive portion of the valve 24 is threaded into the cooling water jacket 23 in the engine. The heat sensitive valve 24 (for instance, Model TVSV of TOYOTA manufacture) is so designed as to assume a closed position at ambient temperature above a given temperature level of the engine.

A pressure responsive valve 25 is incorporated in the passage 15 between the fuel chamber 8 in the auxiliary accelerator-pump 5 and the portion of the float bowl 17 which is above the level of fuel therein. The interior of housing 26 of the valve 25 is partitioned by a diaphragm 27 into a vacuum chamber 28 and a first valve chamber 29 which is communicated with a second valve chamber 31 by way of a central hole 32 provided in a partition wall 30 positioned within the valve 25. A second valve chamber 31 is so positioned as to communicate with the float bowl 17 in the manner described.

Valve body 33 has a stem 34 of smaller diameter than, and extending through, the central hole 32 and coupled to the diaphragm 27. Valve body 33 controls the communication between the fuel chamber 8 in the auxiliary accelerator-pump 5 and a portion of the float bowl 17 above the level of fuel, in cooperation with the partition wall 30 which serves as a valve seat. A coil spring 35 is housed within the vacuum chamber 28. One end of the coil spring 35 is supported by the inner end wall of the valve housing 26, while the other end of the spring urges the diaphragm 27 towards the valve chamber 29, thereby tending to keep the valve open by keeping valve body 33 away from the partition wall 30. The first valve chamber 29 is communicated with a portion of the passage 15 which leads to the fuel chamber 8 in the pump 5, while the second valve chamber 31 is communicated with a portion of the passage 15 which leads to the float bowl 17. The vacuum chamber 28 is communicated with the vacuum take-off port 22. When the engine is stopped, a pressure close to atmospheric prevails at the vacuum take-off port 22 and hence in the vacuum chamber 28 of the valve 25, so that the diaphragm 27 is forced upwards under the action of the spring 35 and hence valve body 33 assumes an open position.

Description will now be given of the operation of the auxiliary accelerator-pump system according to the present invention.

As with the prior art, at the time of cold operation of the engine, the temperature sensitive valve 24 remains in its open position. When the engine is idling after starting, the throttle valve is nearly closed, so that a vacuum is applied through the vacuum take-off port 22 and passage 21 to the vacuum chamber 9 in the auxiliary accelerator-pump 5. The vacuum thus introduced causes the diaphragm 7 to be deflected downwardly against the force of the spring 19, so that the volume of the fuel chamber 8 is enlarged. As a result, fuel is introduced from the float bowl 17 by way of the check valve 16 and the passage 14, into the fuel chamber 8 and stored there.

When the throttle valve 4 is opened for acceleration, the vacuum prevailing from the vacuum take-off port 22 to the vacuum chamber 9 diminishes to almost atmospheric pressure, so that diaphragm 7 is returned to its initial position under the action of spring 19, and thus the fuel in the fuel chamber is forced out of the fuel chamber through the check valve 10 to the pump jet 12, and then injected into the air horn 2 of the carburetor, thereby supplying additional fuel to the engine for acceleration. When the engine warms up to a temperature above a given temperature level, then the temperature sensitive valve 24 closes, thereby shutting off communication of the vacuum chamber 9 with the vacuum take-off port 22.

As has been described earlier, when the ambient temperature is high, there arises a danger that the fuel in the fuel chamber 8, in the pump 5, or in the passages 11 and 13 would be expanded, so that such fuel leaks through the check valve 10 and pump jet 12 into the air horn 2. However, according to the present invention, when the engine is stopped and the vacuum level at the vacuum take-off port 22 is brought close to atmospheric pressure, the valve 25 assumes an open position. As a result, fuel expanded or subjected to a pressure increase may return by way of the passages 13 and 15 and valve 25 to float bowl 17, so that the aforesaid leakage of fuel into the air horn 2 is prevented.

FIG. 2 shows a bimetal valve 41 (Model BVSV of TOYOTA manufacture) which uses a bimetal disc adapted to inverse its convex shape into a concave shape, depending on temperature levels, thereby controlling the communication between the vacuum take-off port 22 and the vacuum chamber 9 in the auxiliary accelerator-pump 5.

Figure 3:
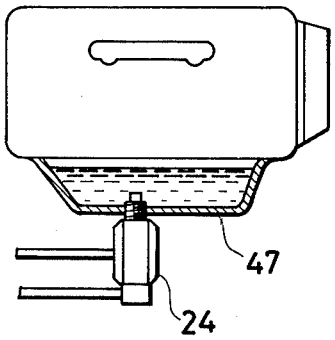
FIG. 3 is a modification of the temperature responsive valve means of FIG. 2.

FIG. 3 shows a heat-sensitive valve 24 which is attached to the oil pan 47 of an engine. Valve 24 thereof serves a purpose similar to that of bimetal valve 41.

As is apparent from the foregoing description, a return passage from the fuel chamber 8 to float bowl 17 is opened when the engine is stopped at an ambient temperature above a given level, so that fuel stored in the fuel chamber is prevented from leaking into the air horn of the carburetor and thus subsequent starting of the engine will now be impaired by leakage of fuel.

Furthermore, it is not mandatory to use the heat- or temperature-sensitive valve shown as at 24 and 41 in the passage connecting the vacuum chamber 9 to a vacuum take-off port 22. This is because even if the auxiliary accelerator-pump is operated at a temperature above said given temperature level, a return passage from the fuel chamber 8 to the float bowl 17 is maintained opened, so that fuel will not leak from the fuel chamber into the carburetor air horn.

Although the present invention has been described with respect to specific details of certain embodiments thereof, it is not intended that such details be limitations upon the scope of the invention except insofar as set forth in the following claims.

What is claimed is:

1. A carburetor with an auxiliary accelerator-pump system, comprising:

an intake passage including a venturi portion and a throttle valve;

a fuel reservoir or bowl;

an auxiliary acceleration-pump including a fuel chamber and a vacuum chamber separated by a spring-loaded diaphragm, said fuel chamber being communicated by way of a first check valve to a pump jet opening into said intake passage upstream of said venturi portion and by way of a second check valve to said fuel reservoir, said fuel chamber being further communicated with a portion of said fuel reservoir above the level of fuel therein, and said vacuum chamber being communicated with a portion of said intake passage downstream of said throttle valve; and a vacuum responsive valve means positioned between said fuel chamber and said portion of said fuel reservoir above the level of fuel, said vacuum responsive valve means including a vacuum chamber communicated with a portion of said intake passage downstream of said throttle valve, and means controlled by said vacuum chamber to communicate said fuel chamber with a portion of said fuel reservoir above the level of fuel.

2. A carburetor with an auxiliary accelerator-pump system as set forth in claim 1 in which said vacuum responsive valve means includes a first valve chamber separated by a spring-loaded diaphragm from said vacuum chamber, a second valve chamber separated by a partition wall from said first valve chamber, and a valve body having a valve stem extending through a central hole in said partition wall and coupled to said diaphragm, whereby said first valve chamber may be communicated with said fuel chamber on one hand and with a portion of said fuel reservoir above the level of fuel on the other hand by way of said center hole in said partition wall so that there is communication between the fuel chamber and the fuel reservoir above the level of the fuel therein.

3. A carburetor with an auxiliary accelerator-pump system as set forth in claim 1, wherein said first check valve allows only the flow of a fluid towards said intake passage, and said second check valve allows the flow of a fluid towards said fuel reservoir.

4. A carburetor with an auxiliary accelerator-pump system as set forth in claim 1, wherein said vacuum chamber is communicated by way of a temperature responsive valve with said intake passage.

5. A carburetor with an auxiliary accelerator-pump system as set forth in claim 4, wherein said temperature responsive valve is a wax-filled heat sensitive type.

6. A carburetor with an auxiliary accelerator-pump system as set forth in claim 5, wherein said heat sensitive valve means is secured to a cooling water jacket of an internal combustion engine.

7. A carburetor with an auxiliary accelerator-pump system as set forth in claim 4, wherein said temperature responsive valve is a bimetal disc type.

8. A carburetor with an auxiliary accelerator-pump system as set forth in claim 7, wherein said temperature responsive valve is secured to a cooling water jacket of an internal combustion engine.

9. A carburetor with an auxiliary accelerator-pump system as set forth in claim 5, wherein said heat sensitive valve is secured to an oil pan of an internal combustion engine.

* * * * *